US005544829A

United States Patent [19]

Bucken et al.

[11] Patent Number: 5,544,829

[45] Date of Patent: Aug. 13, 1996

[54] PALLET TRANSPORT SYSTEM FOR A CHEESE-PRODUCING TEXTILE MACHINE

[75] Inventors: Rene Bucken, Grefrath; Rudolf Consoir, Hückelhoven; Ferdinand-Josef Hermanns, Erkelenz; Gregor Kathke, Viersen; Hans-Werner Schwalm, Mönchengladbach; Waldemar Schultz, Kaarst; Hedde-Christoph Paulsen; Michael Kery, both of Mönchengladbach, all of Germany

[73] Assignee: W. Schlafhorst AG & Co., Moenchengladbach, Germany

[21] Appl. No.: 343,347

[22] Filed: Nov. 22, 1994

[30] Foreign Application Priority Data

Nov. 24, 1993 [DE] Germany ..... 43 39 964.9

[51] Int. Cl.[6] ..... B65H 54/02; B65H 69/04

[52] U.S. Cl. ..... 242/35.5 R; 242/35.5 A; 242/35.6 E

[58] Field of Search ..... 242/35.6 E, 35.6 R, 242/35.5 A, 36, 35.5 R; 57/281

[56] References Cited

U.S. PATENT DOCUMENTS

| | | | |
|---|---|---|---|
| 4,566,644 | 1/1986 | Kiriake | 242/35.5 A |
| 4,634,066 | 1/1987 | Matsui et al. | 242/35.5 A |
| 4,673,138 | 6/1987 | Ichiba | 242/35.6 R X |
| 4,809,919 | 3/1989 | Ueda et al. | 242/35.5 R |
| 4,856,723 | 8/1989 | Tone | 242/35.5 A X |
| 4,917,326 | 4/1990 | Kojima et al. | 242/35.6 E X |
| 5,056,726 | 10/1991 | Grecksch et al. | 242/35.6 E X |
| 5,082,194 | 1/1992 | Grecksch et al. | 242/35.6 R |
| 5,308,001 | 5/1994 | Grecksch et al. . | |
| 5,335,776 | 9/1994 | Backhaus . | |
| 5,364,039 | 11/1994 | Mohrke et al | 242/35.5 A |
| 5,374,000 | 12/1994 | Matsui et al. | 242/35.5 A |

FOREIGN PATENT DOCUMENTS

| | | |
|---|---|---|
| 0548512A1 | 6/1993 | European Pat. Off. . |
| 3448097C2 | 1/1988 | Germany . |
| 4142790A1 | 6/1993 | Germany . |

*Primary Examiner*—Micheal R. Mansen
*Attorney, Agent, or Firm*—Shefte, Pinckney & Sawyer

[57] ABSTRACT

A pallet transport system for a textile cheese winding machine includes a cop delivery and storage track for supplying cops to be rewound, an empty tube return track, and a plurality of transport tracks each extending through one winding head of the bobbin winder transversely between the supply and return tracks. The entrance region of each transverse transport track is closable by selectively operable blocking mechanism disposed in operation to permit empty pallets to enter the transverse transport track while pallets equipped with cops are shunted. In this manner, the transverse transport tracks serve as a storage device for empty pallets which provides the advantage that, at the completion of a batch, the time needed by the bobbin winder to properly end the batch is shortened, and hence the machine's efficiency is increased.

9 Claims, 4 Drawing Sheets

PALLET TRANSPORT SYSTEM FOR A CHEESE-PRODUCING TEXTILE MACHINE

FIELD OF THE INVENTION

The present invention relates to a system for transporting pallet-type holders for textile cops and bobbins in association with a textile winding machine for producing cross-wound yarn packages, sometimes referred to as cheeses. The present transport system has a cop supply track for distributing cop-equipped pallets, a tube return track for disposing of pallets with empty unwound tubes, transverse transport tracks extending between these tracks, and selectively movable means for blocking the entrances of these transverse transport tracks.

BACKGROUND OF THE INVENTION

One such pallet transport system in conjunction with a bobbin winding machine is described in German Patent Disclosure DE 41 42 790 A1 wherein transverse transport tracks are disposed between a cop supply track and a tube return track and are equipped with revolving transport elements in the form of pairs of conveyor belts, and indexable blocking means are disposed in the entrance region of the transverse transport tracks for blocking the transverse transport track entrances. Each indexable blocking means, by way of example, is embodied as a guide profile that can be raised into an inoperative position above the level of the revolving pairs of conveyor belts and selectively lowered into a blocking position to prevent pallets from entering the respective transverse transport track.

A similar bobbin transport system, conceived especially for transporting large volume bobbins, is also known from German Patent DE 34 48 097 C2 wherein a control means in the form of a V-shaped, double-armed steering lever is disposed in the region of the entrance of the transverse transport tracks. A guide arm of the steering lever extends into the transport region of a bobbin delivery track to cause a pallet-equipped pallet being transported over the bobbin delivery track to be rerouted into the transverse transport track. As the pallet enters the transverse transport track, the pallet pushes to the side a control arm of the steering lever, which is offset from the guide arm by about 90 degrees, and as a result swivels the guide arm in-front of the entrance region of the transverse transport track counter to the force of a spring element thereby blocking the transverse transport track to following pallets.

SUMMARY OF THE INVENTION

It is an object of the present invention to provide an improvement in pallet transport systems of the type described above.

The present invention is adaptable to operate with essentially any textile machine of the type used for winding yarn into cheeses and having a plurality of aligned winding heads and a transport system for conveying pallets carrying yarn-wound cops or empty bobbins disposed upright thereon to and from the winding heads. The pallet transport system has at least one cop supply track, at least one empty bobbin return track and plural transport tracks transversely connecting the individual winding heads with the cop supply and bobbin return tracks. In accordance with the present invention, blocking means are disposed in association with each transverse transport track for selective movement into and out of an operative position blocking an entrance region into the transverse transport track from the cop supply track to prevent the transfer of cop-equipped pallets onto the transverse transport track from the cop supply track while permitting empty pallets to be transferred onto the transverse transport track The blocking means offers the advantage that, as needed, each transverse transport track can be functionally converted into a storage means for empty pallets. In this way, empty pallets, which as an example may no longer be needed as a cop batch is being completed, can thus easily be removed from the transport system so that, overall, the time that the bobbin winder needs for a proper ending of a batch is shortened substantially.

In a preferred embodiment, each blocking means has a shunt arm cantilevered in the direction of the cop supply track with an angularly bent end which, in the operative cop-blocking position, extends over the associated transverse transport track at a sufficient height to allow empty pallets to pass beneath the shunt arm into the transverse transport track while, conversely, pallets that are equipped with cops strike the shunt arm with their upwardly extending cops and are thus prevented from entering the respective transverse transport track.

In a first embodiment, each blocking means is functionally connected to the blower chamber of the respective winding head such that the blocking means is moved into its blocking position when the blower chamber opens. When the blower chamber is closed, the blocking means are in a neutral inoperative position spaced from the transverse track, wherein the transport of pallets in the region of the transverse transport track is not hindered. In particular, the blocking means is preferably secured to the pivotably supported jacket elements of the blower chamber and is actuated via the blower chamber actuating mechanism.

In another embodiment, the blocking means operative in the entrance region of an associated transverse transport track is supported independently of the blower chamber and actuable independently in defined fashion via its own drive means. Such an embodiment has the advantage that the blocking means is entirely removed from the region of the transverse transport tracks during the normal course of winder operation.

According to a further feature of the invention, movable blocking means are disposed for blocking operation at both the entrance region and the exit region of the transverse transport tracks.

The blocking means operative in the exit region of a transverse transport track is arranged to completely prevent the passage of all pallets, whether carrying a cop or empty (i.e. without any cop or tube), to the transverse transport exit when moved into the operative blocking position. This means that empty pallets can enter the transverse transport tracks without interference by the blocking means at the entrances to the tracks, but cannot exit the transverse tracks when the exit blocking means is operative. As a result, empty pallets no longer needed in the bobbin transport system collect within the blocked transverse transport tracks within the briefest possible time.

The blocking means disposed in the region of the transverse transport track exit is preferably embodied as two elements, a hook-like projecting end configured for blocking engagement with pallets and mounted to a support bracket by a biasing spring for yielding movement against the spring force. Such an arrangement has the particular advantage that, as needed, the hook-like end can be pivoted away from the transverse track when disposed in the operative blocking position to permit pallets positioned in the transverse transport tracks to be removed by hand.

DETAILED DESCRIPTION OF THE PREFERRED EMBODIMENTS

Figure 1:
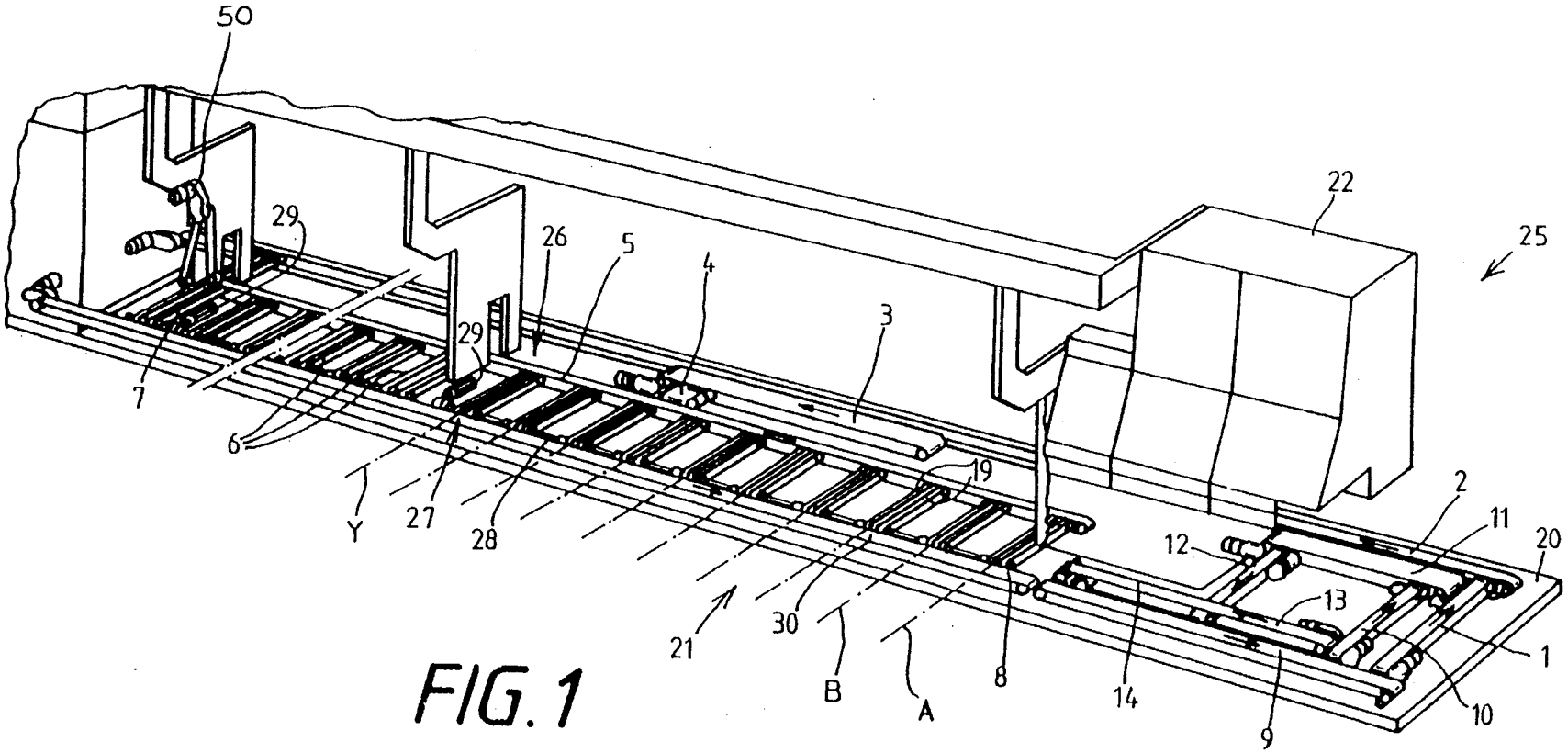
FIG. 1 is a perspective view of a pallet transport system of a textile winding machine (only shown schematically) in accordance with the present invention.

FIG. 1 shows a perspective view of the pallet transport system 21 of a bobbin winding machine 25, which for the sake of simplicity is shown only schematically. The representation of the bobbin winder 25 is essentially limited to the power supply and operating unit 22 disposed at one end of the machine, as well as to positional indications for the multiple aligned winding heads A, B, . . . Y of the machine.

A pallet transport system 21 is arranged on a chassis, identified overall at 20, for delivering yarn-wound bobbins to, and removing unwound empty bobbin tubes from, the several winding heads of the machine by means of a plurality of support pallets, sometimes referred to as peg trays, on which the respective cops and empty bobbins are carried individually, each in an upright disposition about a peg or post extending upwardly from a flat disk-like base of the associated pallet. The transport system 21 has a plurality of different transport tracks, each preferably in the form of a driven conveyor, whose functions are described briefly below.

The transport system includes a transfer track 1 which forms an interface of the present transport system 21 with one or more transport systems of textile machines located upstream in the production process, typically ring spinning machines which supply yarn-carrying cops to the winding machine for rewinding into larger yarn packages, such as cheeses.

The transfer of the cops produced on the ring spinning machines from the transport system thereof to the transport system of the winding machine and the return of the unwound bobbin tubes takes place in the area of the transfer track 1 by means of a known form of transfer device (not shown). The cops placed on the pallets which are associated with the winding machine are initially transported onto and along a transport track 2 extending substantially the length of the machine, from which the pallets are diverted onto one or more cop preparation tracks 3 along which are provided cop preparation stations (not shown) operative to locate the reserve windings formed by the leading end of yarn on each cop and form a winding of the yarn about the nose of the cop in a known manner. Subsequently the cops are transferred by a removal track 4 onto a cop supply track 5, which acts as a cop reserve track. The cop supply track 5 extends alongside the several winding heads of the machine and a plurality of transport tracks 6, each associated with a respective winding head of the machine, extend transversely from the supply track 5 in parallel with one another through the respective winding heads. The cop supply track 5 is driven through a switching device to repetitively reverse traveling directions of its conveyor, whereby the cops positioned on the pallets are transported by and presented to the entrances of the transverse transport tracks 6 which travel away from the supply track 5. Preferably, each of the transverse transport tracks 6 receives three pallets carrying cops, a first pallet being advanced by the transverse track 6 into a winding position inside a blower chamber 31 (not represented in FIG. 1; see FIGS. 2–4) of the respective winding head A,B, . . . Y, etc., while two following pallets rest on the transverse track 6 in reserve or standby positions upstream of the blower chamber.

Once each cop is unwound of its yarn at the respective blower chamber 31, the empty bobbin tube and the supporting pallet are released by the blower chamber 31 and transported by the transverse track 6 to a return track 8 extending along the opposite side of the winding heads in parallel to the supply track 5 and therefrom to a distributing track 9 for return to the transfer track 1, from which the empty tubes are returned by means of a transfer device to the transport system of the ring spinning machines, as previously indicated.

Pallets carrying cops which could not be processed by the preparation devices disposed along the preparation track 3 are conveyed directly to the return track 8 via a transverse connector track 7 and transported by the return track 8 to the distribution track 9. The distribution track 9 conveys pallets carrying bobbins with a small remainder of yarn, any remaining cops and any cops whose reserve yarn end could not be prepared to a conveyor 10, from which the pallets are distributed onto a preparation track 11 to a station for preparing the leading yarn end of any cop or any bobbin having a usable amount of residual unwound yarn, therefrom onto a repetition track 12 along which a special preparation station is arranged to repeat the end preparation process if necessary, or onto a bobbin cleaning track 13 for removing any unusable residual yarn, depending on the particular condition of the respective bobbin or cop on each pallet. Cops which cannot be prepared even in the special preparation station along the repetition track 12 are transferred onto a manual preparation track 14.

Figure 2:
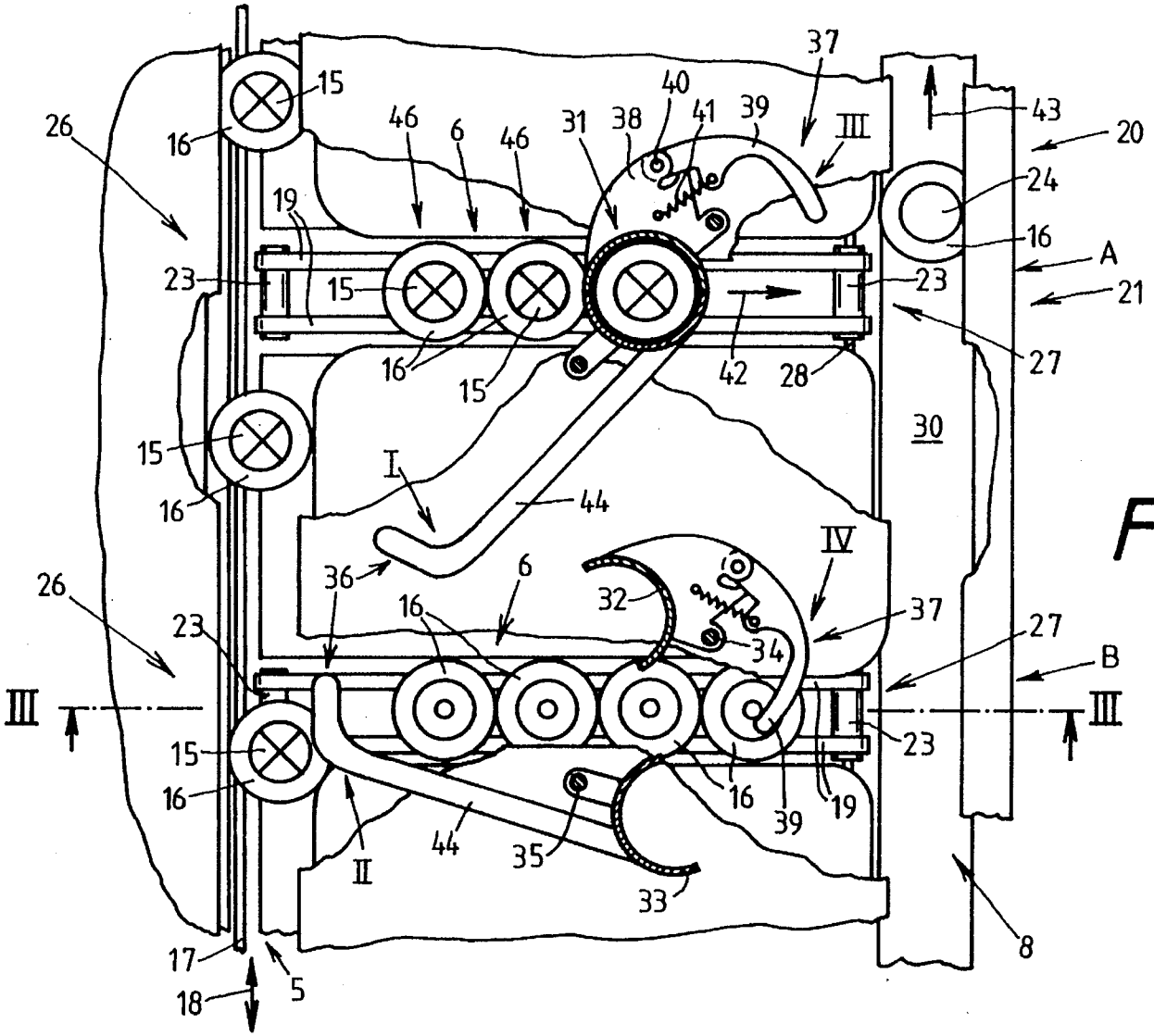
FIG. 2 is a top plan view of a portion of the pallet transport system shown in FIG. 1, showing a first embodiment of the blocking means in association with the transverse transport tracks according to the present invention.
Figure 4:
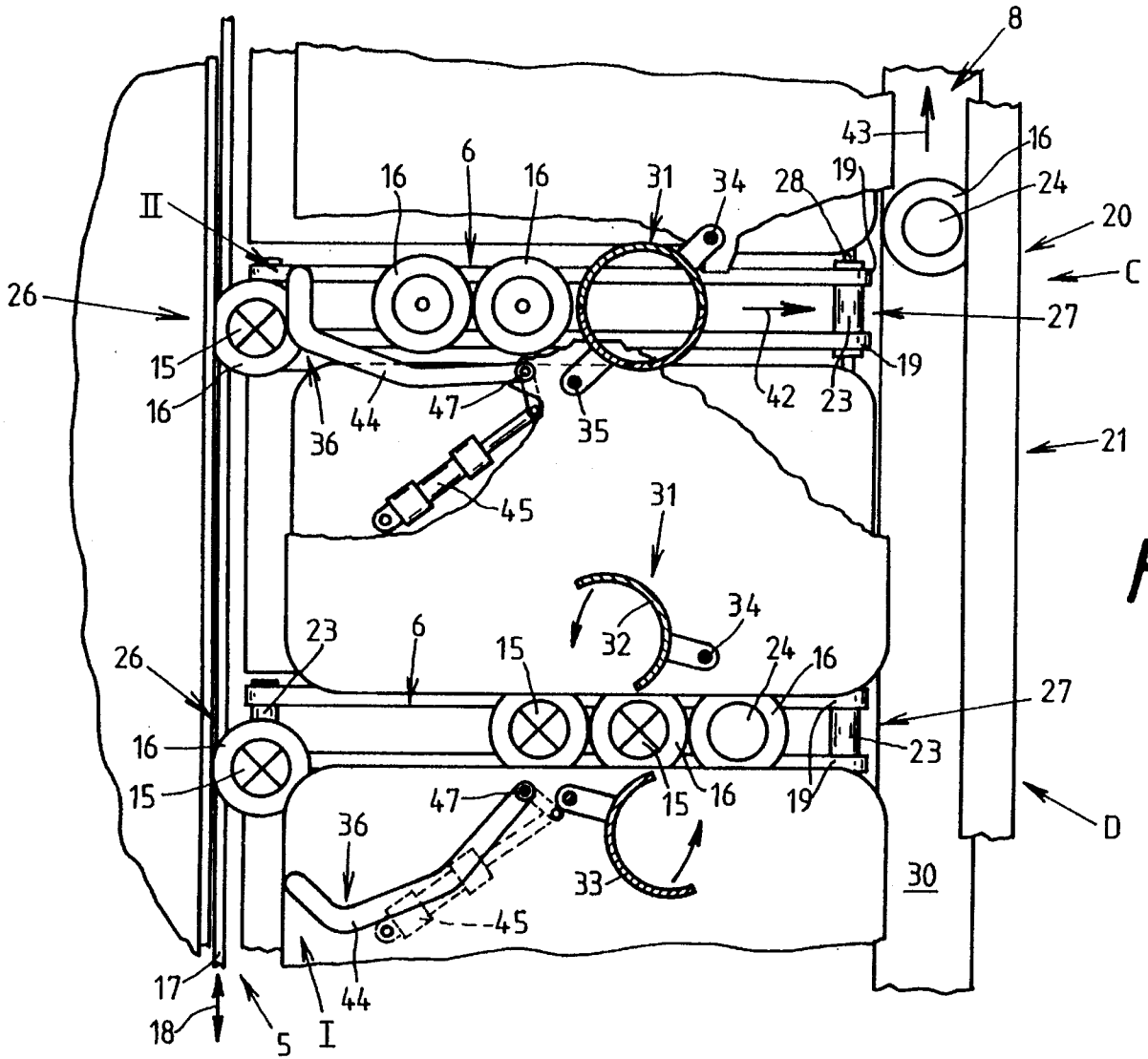
FIG. 4 is another top plan view of a portion of the pallet transport system of FIG. 1, showing a further embodiment of the blocking means disposed in the entrance region of the transverse transport tracks.

As indicated particularly in FIGS. 2 and 4, the cop supply track 5 includes a pallet transport means in the form of a round cord-like belt 17 which extends along the cop supply track 5, the belt 17 being driven alternatingly in opposite directions (as indicated by the arrow 18) by a reversible drive mechanism 50 (see FIG. 1), so that the pallets 16 located on the track 5 and equipped with cops 15 are conveyed continuously back and forth past the entrance regions 26 to the transverse transport tracks 6.

In such bobbin winders, the cop supply and storage track 5 is arranged to extend along the rearward side of the winding heads, while the tube return track 8 extends in parallel thereto along the forward side of the winding heads, with the conveyor belt 30 of the return track 8 being driven in the direction of the arrow 43 to carry away the empty unwound tubes 24 disposed on the pallets 16.

Each transverse transport track 6 includes a pair of parallel spaced-apart conveyor belts 19 trained about the ends of opposed deflection rollers 23 to travel in the direction of the arrow 42 between the cop supply track 5 and the tube return track 8. Each pair of conveyor belts 19 extends sufficiently into the transport path of the cop supply track 5 in the region of the transverse transport track entrance 26 to enable the belts 19 to draw pallets 16 from the track 5 onto the respective transverse transport track 6. In a known manner, each transverse transport track 6 passes through a respective individual winding head A, B, C, D, etc. of the bobbin winder 25. Since the function, arrangement and layout of such winding heads is already known, they have not been shown in detail for the sake of simplicity, and only the blower chamber 31 associated with these winding heads has been shown. The blower chamber 31 of each winding head comprises mating jacket elements 32, 33 rotatably supported about respective pivot shafts 34, 35 for movement toward and away from one another into and out of mating disposition to enclose a cop in unwinding position at the respective winding head.

In a first embodiment of the present invention shown in FIG. 2, blocking means, generally indicated at 36, 37, are secured to the respective jacket elements 32, 33 such that, when the blower chamber 31 opens, the blocking means are transferred from their respective inactive positions indicated at I and III into respective operative blocking positions II and IV.

Figure 3:
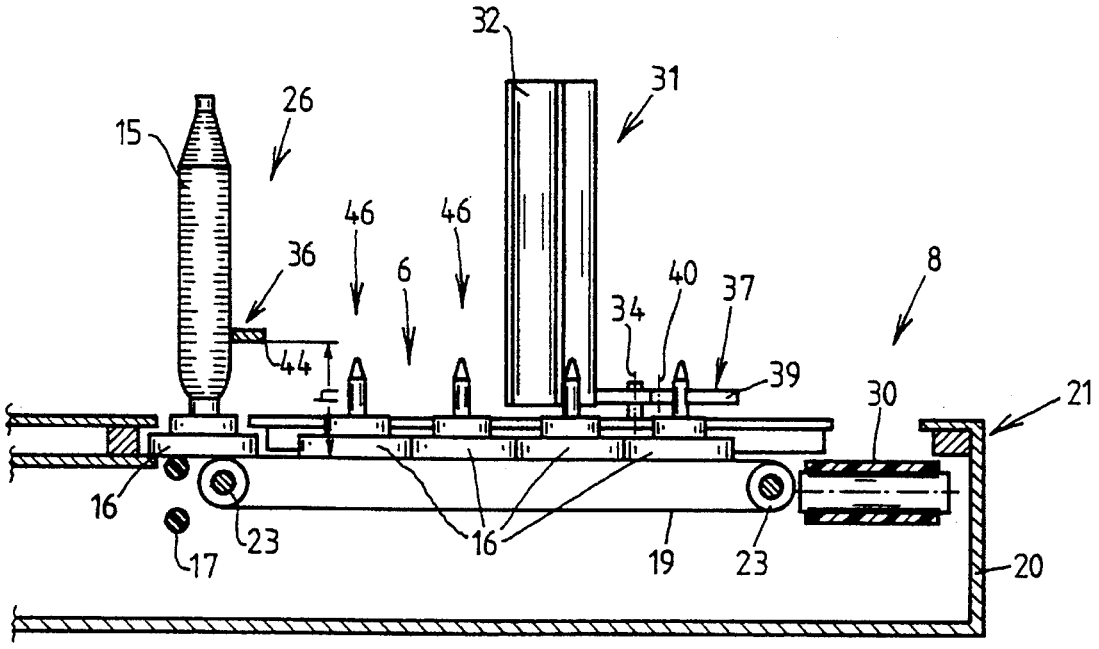
FIG. 3 is a side elevational view of a transverse transport track partially in cross section, taken along the line III—III of FIG. 2.

As illustrated, the blocking means 36 comprises a shunt arm 44 extending outwardly from the jacket element 33 and having an angularly bent free end that pivots with the jacket element 33 into the entrance region 26 of the transverse transport tracks 6, wherein the angled end of the arm blocks cop-equipped pallets 16 from entering the transverse transport tracks 6, as indicated at position II. As shown in FIG. 3, the shunt arm 44 is disposed at a height h above the transport level of the transverse track belts 19 such that empty pallets 16 are not contacted by the shunt arm 44.

The blocking means 37 disposed in the exit region 27 of the transverse transport tracks 6 has a hook-like end projection 39 connected about a pivot shaft 40 to a bracket 38 affixed to the jacket element 32. The hook-like projection 39 can be pivoted relative to the bracket against the force of a biasing spring element 41, to allow the pallets to be removed from the associated transverse track 6 by hand. As indicated at winding head B in FIGS. 2 and 3, a blocking means 37 pivoted into the blocking position IV blocks the transverse transport track exit 27 to empty pallets, so that the respective transverse transport track traps any empty pallets thereon.

In a second embodiment shown in FIG. 4, the shunt arm 44 is mounted independently of the jacket element 33 for movement about a pivot shaft 47 by means of a piston and cylinder mechanism 45 between a neutral inoperative position I indicated at winding head D wherein the arm 44 is disposed outside the transport path of the associated transverse transport track 6 so as not to impede the travel of pallets therealong and a blocking position II indicated at winding head C wherein cop-equipped pallets 16 are prevented from entering the transverse transport track 6.

The operation of the present apparatus may thus be understood. Normal winding operation is depicted in FIG. 2 at winding head A and in FIG. 4 at winding head D. In the first embodiment of FIG. 2 and 3, the blocking means 36, 37 are disposed in the neutral inactive positions I and III, respectively, outwardly spaced from the pallet transport track 6 when the jacket elements 32, 33 are pivoted together so that the blocking means 36, 37 have no influence on either the pallets 16 equipped with cops 15 as they enter the transverse transport tracks 6 or the pallets 16 equipped with empty tubes 24 as they exit the transverse transport tracks 6. The brief hindrance to the entering and exiting of pallets 16 that takes place when the blower chamber 31 opens to release an unwound cop and to receive the next-awaiting cop has virtually no effect on the overall progress of the winding process over time in that the transport track 6 is immediately opened again when the blower chamber closes, so that the just-unwound pallet supporting an empty tube that was briefly hindered from exiting can then easily leave the transverse transport track and a new cop-equipped pallet can be received from the supply track 5 into a standby position 46 in front of the blower chamber 31.

When a cop batch is completed, a number of the blower chambers 31 remain open, i.e. their jacket elements 32, 33 pivoted away from one another to position the blocking means 36, 37 into their blocking positions II and IV, respectively, as is shown in FIG. 2 at winding station B and in FIG. 3.

As indicated in FIG. 3, the shunt arm 44 of the blocking means 36, by its disposition at the height h above the transport level of the transport track 6, is sufficiently elevated above the height of empty pallets 16 that any such empty pallets 16 are therefore unhindered by the shunt arm 44 and can enter the transverse transport tracks 6. Conversely, pallets carrying cops 15 engage the shunt arm 44 by the upwardly projecting extent of the cops 15 and, as shown, are thereby prevented from entering the transverse transport track 6.

With the blower chamber 31 opened, as already noted, the blocking means 37 disposed at the exit side of the transverse transport track 6 is also in the blocking position IV, and in this position prevents any pallets from leaving the transverse transport track 6. Thus, over time, the pallets 16 that at the moment are no longer needed in the bobbin transport system 21 accumulate in the transverse transport tracks 6, so that the transverse transport tracks 6 collectively form a storage means for empty pallets 16.

In the embodiment of the blocking means indicated at winding head D in FIG. 4, the blocking means 36 disposed in the entrance region of the transverse transport tracks 6 is embodied in the form of separately supported shunt arms 44, which serve as cop selector elements. The shunt arms 44 are rotatably supported in pivot shafts 47 for movement inwardly and outwardly toward and away from the transverse transport tracks 6 in a defined fashion via thrust and cylinder mechanisms 45. As shown at the winding head D, the shunt arm 44 is located in its neutral, i.e., inoperative, position I outside the transport path of the associated transverse transport track 6. In this position, the operation of the transport system is unaffected in any way.

At the completion of a cop batch, the shunt arm 44 is pivoted by the thrust cylinder mechanism 45 into the entrance region 26 of its associated transverse transport track 6, wherein the arm performs a selection process of the pallets 16 traveling over the cop supply track 5. More specifically, the arm 44 permits empty pallets 16, i.e., without cops or empty tubes, to enter the transverse transport track 6 while cop-equipped pallets 16 are prevented from entering. At the same time, the blower chamber 31 is closed so that the empty pallets 16 that have entered are prevented from leaving the transverse transport track 6. Thus, in this embodiment as well, the transverse transport track 6 therefore forms a storage means for empty pallets 16.

Advantageously, the overall effect of removing empty pallets 16 from the pallet transport system 21 is a shortening of the time needed by the bobbin winder 25 for a proper ending of a batch, whereby the efficiency of the bobbin winder is increased by the apparatus of the present invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A textile machine for winding yarn into cheeses, having a plurality of aligned winding heads and a transport system for conveying pallets for selectively carrying yarn-wound cops and empty bobbins disposed upright thereon to and from the winding heads, the pallet transport system having at least one cop supply track, at least one empty bobbin return track and plural transport tracks transversely connecting the individual winding heads with the at least one cop supply track and the at least one empty bobbin return track, and blocking means disposed in association with each of the plural transport tracks for selective movement into and out of an operative position blocking an entrance region into any selected transport track from the cop supply track to prevent the transfer of cop-equipped pallets onto the selected transport track from the cop supply track while permitting empty pallets to be transferred onto the selected transport track, wherein each winding head comprises an openable and closable blower chamber disposed in the region of the associated transverse transport track, the blocking means being connected to the blower chamber for disposition in the operative position when the blower chamber is open.

2. The pallet transport system of claim 1, and further comprising a second blocking means disposed at an exit region of each transverse transport track for selective movement into and out of an operative position preventing pallets from exiting the transverse transport track.

3. A textile machine for producing cheeses according to claim 2, wherein each winding head comprises a blower chamber having mating elements movable into and out of mating relation, the first-mentioned and second blocking means being connected to a respective one of the mating elements of each blower chamber.

4. A textile machine for producing cheeses according to claim 2, wherein the second blocking means includes a movable pallet engagement portion and a yieldable spring biasing the pallet engagement portion.

5. A textile machine for producing cheeses according to claim 1, wherein the blocking means comprises a pivotable shunt arm and an actuating means for moving the shunt arm between an inactive position and the operative position.

6. A textile machine for producing cheeses according to claim 6, wherein the actuating means for the shunt arm comprises a piston and cylinder mechanism.

7. A textile machine for producing cheeses according claim 1, wherein the blocking means comprises a shunt arm operative at a sufficient elevation above the transverse transport track to permit empty pallets to pass beneath the shunt arm.

8. A textile machine for winding yarn into cheeses, having a plurality of aligned winding heads and a transport system for conveying pallets for selectively carrying yarn-wound cops and empty bobbins disposed upright thereon to and from the winding heads, the pallet transport system having at least one cop supply track, at least one empty bobbin return track and plural transport tracks transversely connecting the individual winding heads with the at least one cop supply track and the at least one empty bobbin return track, a first blocking means disposed in association with each of the plural transport tracks for selective movement into and out of operative position blocking an entrance region into any selected transport track from the cop supply track to prevent the transfer of cop-equipped pallets onto the selected transport track from the cop supply track while permitting empty pallets to be transferred onto the selected transport track, and a second blocking means disposed at an exit region of each of the plural transport tracks for selective movement into and out of an operative position preventing pallets from exiting any selected transport track, wherein each winding head comprises a blower chamber having mating elements movable into and out of mating relation, the first-mentioned and second blocking means being connected to a respective one of the mating elements of each blower chamber.

9. A textile machine for winding yarn into cheeses, having a plurality of aligned winding heads and a transport system for conveying pallets for selectively carrying yarn-wound cops and empty bobbins disposed upright thereon to and from the winding heads, the pallet transport system having at least one cop supply track, at least one empty bobbin return track and plural transport tracks transversely connecting the individual winding heads with the at least one cop supply track and the at least one bobbin return track, and a first blocking means disposed in association with each of the plural transport tracks for selective movement into and out of an operative position blocking an entrance region into any selected transport track from the cop supply track to prevent the transfer of cop-equipped pallets onto the selected transport track from the cop supply track while permitting empty pallets to be transferred onto the selected transport track, and a second blocking means disposed at an exit region of each of the plural transport tracks for selective movement into and out of an operative position preventing pallets from exiting any selected transport track, wherein the second blocking means includes a movable pallet engagement portion and a yieldable spring biasing the pallet engagement portion.

* * * * *